United States Patent [19]

Berchtold

[11] 4,200,066

[45] Apr. 29, 1980

[54] INTERNAL COMBUSTION PISTON ENGINE

[75] Inventor: Ernst Berchtold, Nanikon-Greifensee, Switzerland

[73] Assignee: Sulzer Brothers Limited, Winterthur, Switzerland

[21] Appl. No.: 865,516

[22] Filed: Dec. 29, 1977

[30] Foreign Application Priority Data

Jan. 28, 1977 [CH] Switzerland ..... 1065/77

[51] Int. Cl.[2] ..... F01L 3/00

[52] U.S. Cl. ..... 123/41.31; 123/41.41; 123/41.77; 123/41.85; 123/188 GC; 123/188 S

[58] Field of Search ..... 123/41.31, 41.41, 41.76, 123/41.77, 41.85, 188 GC, 188 S, 41.34, 189

[56] References Cited

U.S. PATENT DOCUMENTS

| | | | |
|---|---|---|---|
| 3,945,356 | 3/1976 | Kuhn | 123/41.41 |
| 4,000,730 | 1/1977 | Ottl et al. | 123/41.85 |
| 4,008,695 | 2/1977 | Bouquet | 123/41.85 |

FOREIGN PATENT DOCUMENTS

| | | | |
|---|---|---|---|
| 2441689 | 3/1976 | Fed. Rep. of Germany | 123/188 |
| 2558775 | 7/1977 | Fed. Rep. of Germany | 123/41.77 |
| 272380 | 12/1950 | Switzerland | 123/188 |
| 394229 | 6/1933 | United Kingdom | 123/189 |

*Primary Examiner*—Ronald H. Lazarus
*Assistant Examiner*—Jeffrey L. Yates
*Attorney, Agent, or Firm*—Kenyon & Kenyon

[57] ABSTRACT

The cage for the valve seat is provided with cooling ducts which are uniformly spaced about the cage. Alternating ducts are used as coolant supply ducts while the remaining ducts are used as exhaust ducts. The ducts are arranged to uniformly cool the cage and valve seat. Suitable cross ducts are used to achieve a uniform distribution of the coolants supplied to the cage as well as a uniform removal of a coolant.

3 Claims, 7 Drawing Figures

INTERNAL COMBUSTION PISTON ENGINE

This invention relates to an internal combustion piston engine and more particularly to a cooled valve construction for an internal combustion engine.

As is known, in heavy duty internal combustion engines, particularly heavy oil fueled engines, it is advantageous to cool the valve seat portions. This gives better cooling of the valve body and thus reduces the exposure of the valve body to the risk of high-temperature corrosion. In some cases, it has been known to fit an interchangeable valve seat component into a bore in a cylinder head of the engine and to enclose the cylinder head with an annular chamber situated in the flow path of a coolant. During operation, coolant is supplied and discharged under these conditions via bores which are disposed substantially diametrically opposite to one another and which communicate with cooling chambers in the cylinder head.

However, cooling of the seat part frequently gives rise to fresh problems which are usually related to an uneven temperature distribution in the circumferential direction of the valve as a result of the cooling effect. As is known, an uneven temperature distribution may well impair the roundness of the valve seat. This, in turn, may well have an adverse effect on the heat transfer from the valve body to the seat part and also on the sealing of the combustion chamber of the engine. As a result, leakage gases may also cause local overheating or may convey impurities to the seat part. This would further intensify the adverse effects.

Accordingly, it is an object of the invention to provide a cooling arrangement for a valve seat which is able to affect a uniform cooling of the valve seat.

It is another object of the invention to obtain the best possible balanced temperature distribution within a valve seat of an internal combustion engine.

Briefly, the invention provides an internal combustion piston engine with a combination of a guide sleeve for a valve stem and a valve cage which is disposed about the sleeve to define a pair of coolant collecting chambers therebetween. The cage is provided with a valve seat at one end and a cooling chamber adjacent the valve seat. In addition, the cage has a plurality of supply ducts between one of the coolant collecting chambers and the cooling chamber adjacent the valve seat in order to deliver coolant to the cooling chamber as well as a plurality of return ducts between the cooling chamber and the other of the coolant collecting chambers in order to discharge the coolant from the cooling chamber. These supply and return ducts are disposed circumferentially of the cage in alternating relation to each other.

In one embodiment, the two collecting chambers are of annular form and are disposed in co-axially spaced relation along the length of the cage. In this case, a wall surrounding the collecting chamber closest to the cooling chamber is provided with projecting portions through which the supply ducts extend.

In another embodiment, the collecting chambers are equi-distant from the cooling chamber and extend over a part of the circumference of the cage. In this case, transfer ducts are used to connect each of the respective collecting chambers with the respective supply and return ducts on an opposite side of the cage.

The arrangement of the sleeve and cage are provided for an internal combustion piston engine having a cylinder head in which the cage can be inserted. In addition, a valve stem is reciprocally mounted within the guide sleeve for seating on the valve seat.

The above construction allows the flow paths for the coolant to be arranged substantially symetrically to the axis of the exhaust valve group. At the same time, the ducts which are distributed over the circumference of the cage permit a homogeneous temperature distribution in the coolant chamber adjacent the valve seat without effecting any unfavorable temperature conditions in the cage between the collecting chambers and the valve seat as might produce undesirable stresses and deformations. Further, the arrangement of the flow paths for the coolant allows the cage to be fabricated without large accumulations of material.

In the case where the coolant collecting chambers are separated from each other, each may individually enclose the valve stem guide sleeve in the form of a ring. This embodiment also provides a very simple direct connection of the coolant ducts to the collecting chambers. In the case where the collecting chambers are at equal distances from the valve seat, a relatively compact construction of the valve group can be obtained in an axial direction.

These and other objects and advantages of the invention will become more apparent taken in conjunction with the following detailed description and the accompanying drawings in which.

Figure 1:
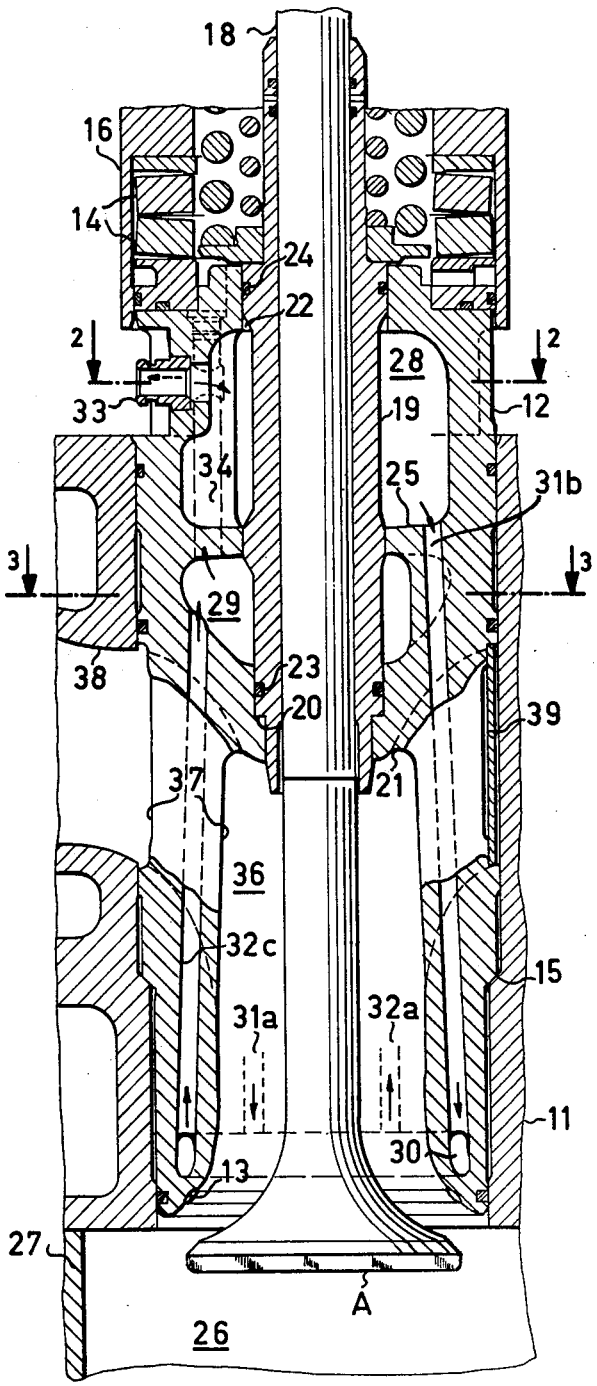
FIG. 1 illustrates a cross-sectional view of an exhaust valve group and an internal combustion piston engine constructed in accordance with the invention.

Referring to FIG. 1, an internal combustion piston engine is provided with a cylinder head 11 into which a valve cage 12 is inserted. As shown, the valve cage 12 includes a valve seat 13 at one end which is formed by hard-metal built-up welding. The cage 12 is pressed against a shoulder 15 of the cylinder head 11 by means of cup springs 14 via a valve rocker casing 16 (shown in part) which is, in turn, fixed on the cylinder head 11 by means of screw bolts (not shown). In addition, a guide sleeve 19 is inserted in the valve cage 12 to guide a valve stem 18 reciprocally within the cylinder head 11. The valve stem 18 carries a valve body A at the lower end, as viewed, which is adapted to seat on the valve seat 13.

The guide sleeve 19 bears against a shoulder 20 formed on an intermediate bottom 21 of the valve cage 12 while the top part of the sleeve 19 is disposed within a bore 22 of the valve cage 12. Suitable sealing rings 23, 24 are provided in the region of the intermediate bottom 21 and the bore 22 in order to seal the sleeve 19 with respect to the cage 12. In addition, a second intermediate bottom 25 encloses the guide sleeve 19 with a sliding fit.

The valve body A serves to control the escape of gases from a combustion chamber 26 which is defined in part by a cylinder 27 and, in part, by the cylinder or valve head 11.

Figure 2:
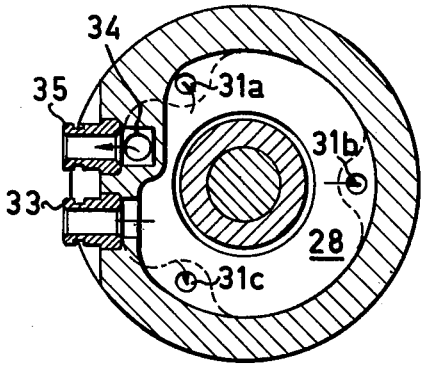
FIG. 2 illustrates a view taken on line 2—2 of FIG. 1.

As shown, the cage 12 has two coolant collecting chambers 28, 29 formed in the top part which are separated by the intermediate bottom 25. Each of these chambers 28, 29 is connected to a coolant chamber 30 adjacent to the valve seat 13 by a plurality of circumferentially arranged ducts. As shown in FIG. 2, three coolant supply ducts 31*a*, 31*b*, 31*c*, communicate the upper chamber 28 directly with the coolant chamber 30 so as to deliver coolant to the cooling chamber 30. In a similar manner three return ducts 32*a*, 32*b*, 32*c* communicate the cooling chamber 30 directly with the lower collecting chamber 29. These coolant ducts 31, 32 are distributed uniformly over the circumference of the valve cage 12 in an alternating fashion. That is, a coolant supply duct 31 preceeds a coolant return duct 32 in the circumferential direction of the cage 12.

The upper collecting chamber 28 is connected to a coolant source (not shown), for example to a source of cooling water, via a nipple 33. As shown in FIG. 2, the lower collecting chamber 29 is connected to a nipple 35 via a bore 34 for the discharge of coolant. This nipple 35 is connected via a suitable conduit (not shown) to a coolant discharge point.

Figure 3:
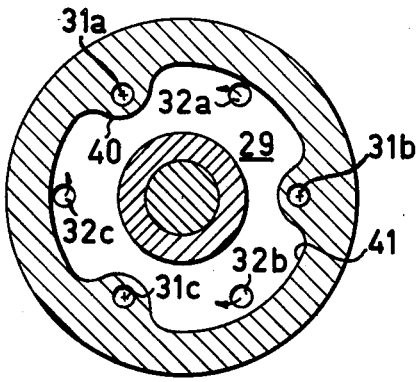
FIG. 3 illustrates a view taken on line 3—3 of FIG. 1.

Referring to FIGS. 2 and 3, the coolant ducts 31, 32 are constructed as bores within stilts 37 of the cage 12 in the region of a flow passage 36 for the gases discharging from the combustion chamber 26 when the valve is open. As shown in FIG. 1, an exhaust bore 38 is provided for the exhaust of these gases. In addition, a protective plate 39 is disposed opposite to the exhaust bore 38 in the valve cage 12 in order to protect the cylinder head 11 from the effective heat.

As also shown in FIG. 3, the wall 41 of the chamber 29 closest to the cooling chamber 30 has a plurality of portions 40 which project into the collecting chamber 29. These portions 40 serve to encase the coolant ducts 31.

Instead of using stilts 37, a continuous wall may also be provided to receive the cooling ducts with an aperture in the zone of the exhaust bore 38 for the exhaust of the combustion gases.

During operation, coolant is fed to the collecting chamber 28 via the nipple 33 and flows through the coolant ducts 31*a*, 31*b*, 31*c* to the coolant chamber 30. Thereafter, the coolant is discharged through the coolant ducts 32*a*, 32*b*, 32*c* to the collecting chamber 29. In this regard, note is made that each coolant duct 32 is disposed between two coolant ducts 31 as considered in the circumferential direction of the valve cage 12. The coolant then exhausts from the collecting chamber 29 via the bore 34 and nipple 35.

The alternating arrangement of the coolant ducts 31, 32 gives substantially balanced temperature conditions in the valve seat 13, in the region of the ducts 31, 32 and in the region of the collecting chamber 28, 29.

Figure 4:
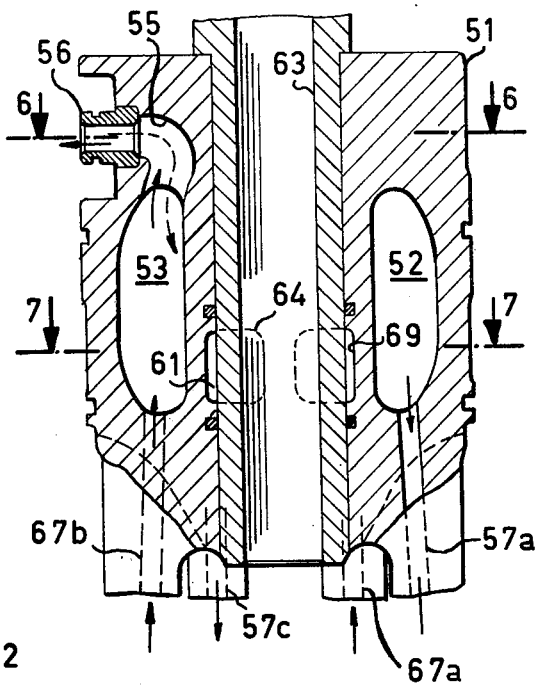
FIG. 4 illustrates a view similar to FIG. 1 of an embodiment having two coolant collecting chambers disposed at equal distances from a valve seat and as taken on line 4—4 of FIG. 6.
Figure 6:
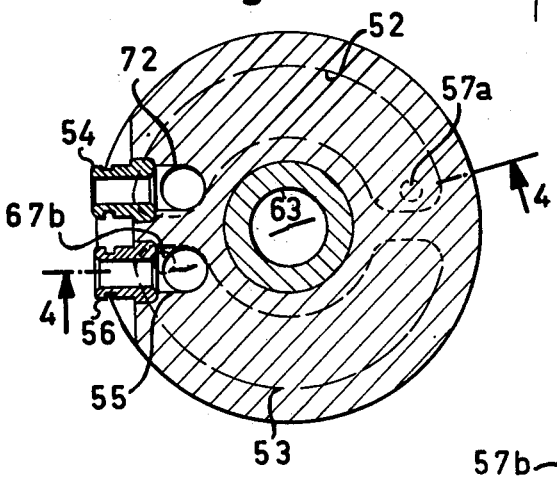
FIG. 6 illustrates a view taken on line 6—6 of FIG. 4.

Referring to FIG. 4, instead of positioning the coolant collecting chambers coaxially of the valve cage, the coolant collecting chambers 52, 53 may be disposed in equi-distant relation to the cooling chamber (not shown). In this case, as shown in FIG. 6, the collecting chambers 52, 53 each extend over a part of the circumference of the valve cage 51. One chamber 52 is connected by a duct 72 and a nipple 54 (FIG. 6) to a coolant source (not shown) in order to receive a supply of coolant. In a similar fashion, the other collecting chamber 53 is connected via a duct 55 and a nipple 56 to a coolant discharge point (not shown) in order to discharge the coolant.

Figure 5:
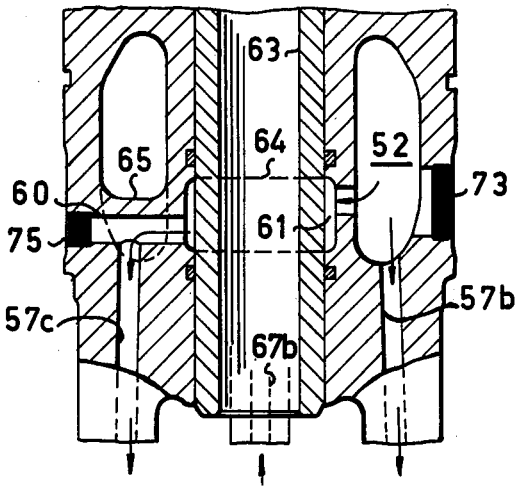
FIG. 5 illustrates a view taken on line 5—5 of FIG. 7.
Figure 7:
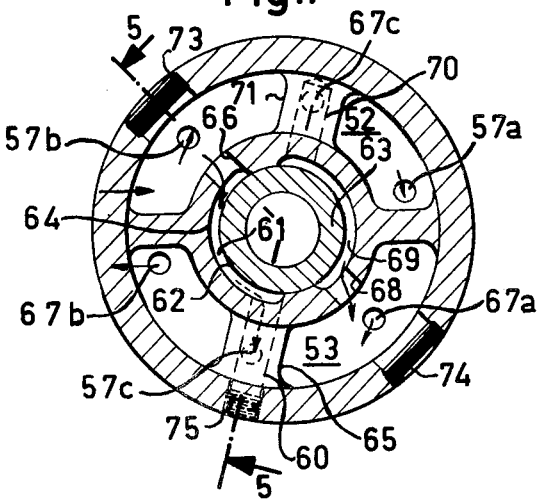
FIG. 7 illustrates a view taken on line 7—7 of FIG. 4.

As shown in FIG. 7, the collecting chamber 52 is connected to the coolant chamber adjacent to a valve seat via three coolant supply ducts 57*a*, 57*b*, 57*c*. The ducts 57*a*, 57*b* extend rectilinearly from the collecting chamber 52 to the coolant chamber and are constructed as bores in the valve cage 51. The duct 57*c* is connected, as shown in FIG. 5, via a radial bore 60 in the web 65 and a split chamber 61 to the chamber 52. As shown, the split chamber 61 is defined by an outer wall 62 of the guide sleeve 63 for a valve stem (not shown) and a groove 64 in the cage 51 which extends circumferentially over about 150°. This chamber 61 communicates directly with the collecting chamber 52 via a bore 66.

The collecting chamber 53 is similarly connected, on the one hand, directly to the valve cage coolant chamber via duct 67*a*, 67*b* and, on the other hand, via a radial bore 68, split chamber 69 and a bore 70 in web 71 of the cage 51 to the coolant duct 67*c*. This latter duct 67*c* is located in a part of the periphery of the valve cage 51 opposite to the collecting chamber 53 (see FIG. 7).

Bores are provided in the walls of the valve cage 51 for casting purposes to produce the various radial bores 66, 68, 60. These bores are closed by screw threaded plugs 73, 74, 75 as shown.

In operation, coolant is fed via the nipple 54 (FIG. 6) to the collecting chamber 52. The coolant then flows via the coolant ducts 57*a*, 57*b*, 57*c* to the coolant chamber (30 as shown in FIG. 1). The return flow of coolant passes through the coolant return ducts 67*a*, 67*b*, 67*c* to the collecting chamber 53. The coolant is then discharged via the duct 55 and the nipple 56 (FIG. 6).

Again, the alternating arrangement of the coolant ducts 57, 67 about the circumference of the valve cage 51 insures substantially balanced temperatures in the region of the coolant ducts, the valve seat, and in the region of the collecting chambers 52, 53.

What is claimed is:

1. In combination;

a guide sleeve for a valve stem; and a valve cage disposed about said sleeve to define a pair of annular coolant collecting chambers disposed in coaxially spaced relation along said cage, said cage having a valve seat at one end, a cooling chamber adjacent said seat, a plurality of supply ducts between one of said coolant collecting chambers and said cooling chamber to deliver coolant to said cooling chamber, a plurality of return ducts between said cooling chamber and the other of said coolant collecting chambers to discharge coolant from said cooling chamber, and a wall surrounding said collecting chamber closest to said cooling chamber, said wall having a plurality of portions projecting into said collecting chamber and having said return ducts extending therethrough, said supply and return ducts being disposed circumferentially of said cage in alternating relation to each other.

2. The combination as set forth in claim 1 wherein said cage and said sleeve define said collecting chambers therebetween.

3. In an internal combustion piston engine, the combination of a cylinder head;

a guide sleeve;

a valve cage inserted in said cylinder head about said sleeve to define a pair of annular coolant collecting chambers disposed in coaxially spaced relation along said cage, said cage having a valve seat at one end, a cooling chamber adjacent said seat, a plurality of supply ducts between one of said coolant collecting chambers and said cooling chamber to deliver coolant to said cooling chamber, a plurality of return ducts between said cooling chamber and the other of said coolant collecting chambers to discharge coolant from said cooling chamber, and a wall surrounding said collecting chamber closest to said cooling chamber, said wall having a plurality of portions projecting into said collecting chamber and having said return ducts extending therethrough, said supply and return ducts being disposed circumferentially of said cage in alternating relation to each other; and a valve stem reciprocally mounted within said sleeve for seating on said valve seat.

* * * * *